US006397403B1

(12) United States Patent
Waldman

(10) Patent No.: US 6,397,403 B1
(45) Date of Patent: Jun. 4, 2002

(54) NECK GARMENT

(76) Inventor: Ellen Waldman, 30 Stephens Mill Rd., Hackettstown, NJ (US) 07840

( * ) Notice: Subject to any disclaimer, the term of this patent is extended or adjusted under 35 U.S.C. 154(b) by 0 days.

(21) Appl. No.: 09/884,398

(22) Filed: Jun. 19, 2001

(51) Int. Cl.[7] ..... A41D 23/00
(52) U.S. Cl. ..... 2/468; 2/91
(58) Field of Search ..... 2/69, 85, 93–94, 2/115, 108, 69.5, 129, 101, 208, 468, 91, 242, 23, 2.15, 102, 2.17, 2.11, 2.14, 123

(56) References Cited

U.S. PATENT DOCUMENTS 746,586 A * 12/1903 Schoch et al. ..... 2/91
4,495,660 A * 1/1985 Hayden ..... 2/91
4,833,732 A * 5/1989 Harmsen ..... 2/102
4,862,517 A * 9/1989 Meistrell ..... 2/2.11
5,153,938 A * 10/1992 Epperson ..... 2/2.11
5,806,090 A * 9/1998 Johnson ..... 2/2.15
6,185,752 B1 * 2/2001 Hendersen et al. ..... 2/242

* cited by examiner

*Primary Examiner*—Gloria M. Hale
*Assistant Examiner*—Tejash Patel
(74) *Attorney, Agent, or Firm*—Benjamin Appelbaum

(57) ABSTRACT

A neck garment comprises a body having two ends, a zipper attached to the body near the ends, thereby forming two flaps which are positioned beneath the zipper. The zipper is not as long as the ends, and the remainder of the ends are stitched together. The zipper is attached to the body at an angle that is about 45 degrees, such that when the zipper is moved into a closed position, the garment enables the wearer to warm their neck, and when the wearer wants to cool down, the zipper is moved into an open position, the ends are separated and remain open, exposing an area of the wearer and enabling the exposed area to be cooled down without interference from the garment. The garment is particularly suited for outdoor activities such as skiing.

7 Claims, 1 Drawing Sheet

NECK GARMENT

FIELD OF THE INVENTION

The present invention is an article of apparel which warms the wearer's neck during cold weather, and includes a means to open it readily so the wearer can maintain a comfortable temperature while participating in outdoor activities, such as skiing, ice skating, snowmobiling and the like.

BACKGROUND OF THE INVENTION

In the northern hemisphere, keeping warm in winter is often a problem. When engaging in outdoor activities such as skiing, sledding, iceskating, snowmobiling and the like, this situation can be exacerbated; exposed body parts become even colder because of their exposure to the wind created by the speed of the participant moving through the cold environment. To protect against exposure, and keep the neck and face warm, people wear various items such as ski masks, scarves, or mufflers to cover these regions. While these garments initially help to warm up or protect the exposed areas from the cold, because of the heat generated by the individual while engaging in these activities, that additional heat can, over time, lead to overheating. Because many of these activities require the participant to maintain their balance, or to maintain their concentration, it becomes difficult to adjust or remove these items without risking a potential accident.

Hayden (U.S. Pat. No. 4,495,660) discloses a neck garment comprising a muffler portion and an integral apron portion, formed from a single sheet of material. The garment includes a set of interengageable fastening means that extend across the width of each end of the material, such that the garment can be put on and around the wearer's neck without having to be extended over the wearer's head. The closure can be either a zipper, hook and loop fasteners, buttons or snaps.

In U.S. Pat. No. 4,168,543 Baker discloses a protective neck garment, which is a one-piece, continuous, resiliently stretchable structure that is generally tubular in shape and adapted to fit over and conform closely to the wearer's neck. An embodiment includes an inner layer intended to protect the wearer's neck from irritation by the garment's outer layer. The inner layer extends beyond the outer layer, and can be rolled over the outer layer. The outer layer may be made from an insulating material, such as stretch wool, and the inner layer of cotton to protect the wearer's neck from irritation.

Coursey (U.S. Pat. No. 2,507,333) discloses a closure for mufflers, wherein the zipper is inserted into the garment such that the zipper is hidden when the garment is closed.

U.S. Pat. No. 2,042,442 (Buchman) discloses a scarf which is closed by a zipper (which is exposed) when worn on the individual's neck. Buchman discloses using down, sewn in pockets within the scarf, for added warmth.

In U.S. Pat. No. 811,096 Scott discloses a muffler which is closed by means of snap fasteners, positioned in the back of the muffler when worn.

Herbranson (U.S. Pat. No. 2,346,918) discloses a one piece neck scarf comprising a rectangular piece of fabric and a zipper attached along a side of the fabric, and the zipper can be used to completely or partially fasten the scarf when worn around the wearer's neck.

In U.S. Pat. No. 746,586 Schoch et al. disclose a combination muffler and chest protector, one embodiment for males and another for females. The female embodiment uses fasteners, such as buttons or snaps, to close the muffler at the back, when worn by the user.

Campbell (U.S. Pat. No. 4,601,066) discloses a combination fashion and exercise garment including warmers that are attached to the garment and which wrap around the desired body part. The garment includes warmers, strips of material attached at one end to the garment, and which further comprises mating strips to secure the warmer around the body part. The warmers may be permanently attached to the garment by stitching or similar means, or removably attached thereto by means of snaps.

Mustata (U.S. Pat. No. 5,802,618) discloses a neck and chest scarf which comprises several layers of material which, when worn, are closed by means of a hook and loop fastener at the back of the user's head and neck. The inventor states that a zipper can be substituted for the hook and loop closures, but using such types of closure at the rear of a garment worn by participants in an active outdoor activity is impractical, particularly in activities where an individual may have other equipment in their hands, or where the individual must maintain their balance.

In U.S. Pat. No. 6,163,883 Hong discloses a garment with a magnetic vent closure, as an example of a garment which can be used for flow-through cooling of the user, such as a motorcyclist, during warm weather and which can be used in conjunction with other protective clothing.

A recurrent problem with conventional neck warmers or masks is that once they are opened, the material still remains on the body part sought to be cooled. Because many of the aforementioned activities require the participant to maintain their balance, or to maintain their concentration, it becomes difficult to adjust or remove these items without risking a potential accident. Furthermore, many individuals engaged in activities such as skiing now wear helmets to protect against the risk of head injury, as well as goggles for eye protection. Helments and goggles add to the bulk around the individual's neck, and are usually not removed during these activities. A scarf or muffler, once opened, still physically remains in the area, and it may literally be "flapping around in the wind", which can, for example only, cause further distraction, block the wearer's vision or other consequences. Even using a jacket having a zipper which extends over the wearer's neck and face, once the zipper is opened there still is material that needs to be removed from the area to cool it down. This inventor has observed this problem with garments including zippers used in the conventional manner (i.e., straight up and down, along the length of the wearer's neck). The present invention overcomes this problem by altering the angle at which the zipper is positioned within the garment, thereby enabling the opened muffler to lay out of the way, and allow for cooling of the warmed area.

The present invention is an article of clothing designed for keeping the wearer's neck warm during outdoor activities, such as skiing or other cold weather activities. The garment is made of a single piece of fabric, and includes a zipper which is sewn in at an approximately 45 degree angle in relation to the length of the wearer's neck. The garment is made such that there is a layer of material beneath the zipper, to protect the wearer's neck from contact with the zipper. By using a zipper at this particular angle, the inventor has found the garment can be opened readily by a user while skiing, and can also be kept open, offering the wearer the ability to cool off readily, yet be out of the way, a problem that occurs when a zipper is used in the conventional manner.

BRIEF SUMMARY OF THE INVENTION

It is an object of the present invention is to provide a garment that will provide warmth to its wearer, and be sufficiently easy to open to enable the wearer to cool down.

Another object of the present invention is to provide a garment that when opened, will lay out of the way of the wearer.

Another object of the present invention to provide a garment that is easy to use by an individual participating in activities during cold weather.

Another object of the present invention is to provide a garment that is economical to manufacture, and is durable to withstand repeated use.

The present invention is an article of clothing designed for keeping the wearer's neck warm during outdoor activities, such as skiing or other cold weather activities. The garment comprises a body having two ends, a zipper attached to the body near the ends, thereby forming two flaps which are positioned beneath the zipper. The zipper is not as long as the ends, and the remainder of the ends are stitched together. The zipper is attached to the body at an angle that is about 45 degrees, such that when the zipper is moved into a closed position, the garment enables the wearer to warm their neck, and when the wearer wants to cool down, the zipper is moved into an open position, the ends are separated and remain open, exposing an area of the wearer and enabling the exposed area to be cooled down without interference from the garment. The garment is particularly suited for outdoor activities such as skiing.

DETAILED DESCRIPTION OF THE INVENTION

Figure 1:
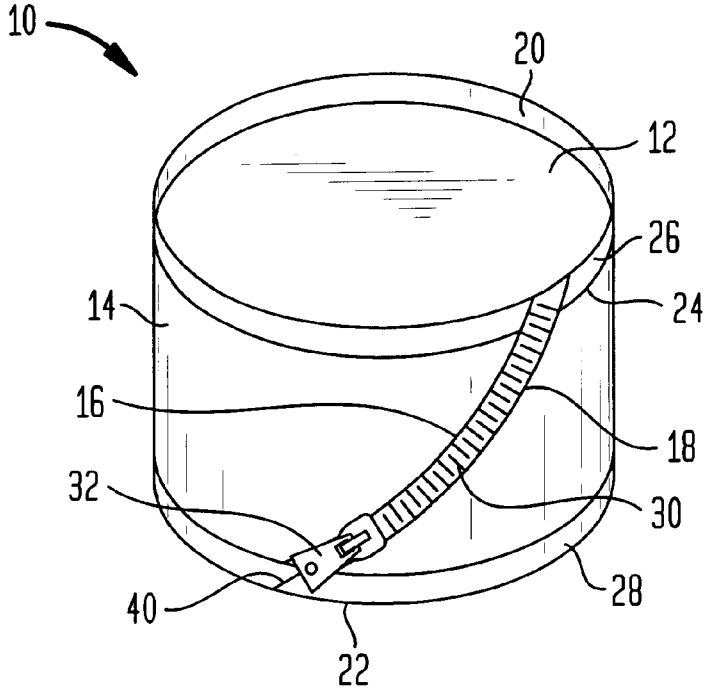
FIG. 1 is a plan view of the present invention in the closed position.

The present invention is an article of clothing 10 designed for wearing about the user's neck during cold weather activities, such as skiing, iceskating, snowmobiling or the like. While the present invention is intended for use in outdoor activities, it is to be understood that the present invention could be worn indoors, such as in an ice skating arena or the like, and no limitation to outdoor wear is intended, or for its use at specific temperatures or climates, except as described within the appended claims.

The present invention 10 (FIG. 1) is made from a single piece of fabric, having a first (inner) surface 12 and a second (outer) surface 14 and two ends 16 and 18, which pattern (not shown) essentially has the form of a parallelogram. When assembled, the first surface 12 becomes the inner surface 12 of the garment, and the second surface 14 becomes the outer surface 14 (FIG. 1).

Prior to assembly, and to create a more finished appearance, a portion 20 and 22 of the outer surface 14, are folded over onto a portion of inner surface 12 and joined together by means of stitching 24 to form upper seam 26 and lower seam 28. It is to be understood that other means of attaching fabrics to one another to form seams can be employed, and such methods can include attachment by means of heat, hot melt glues, or other methods known to those skilled in the art.

Figure 2:
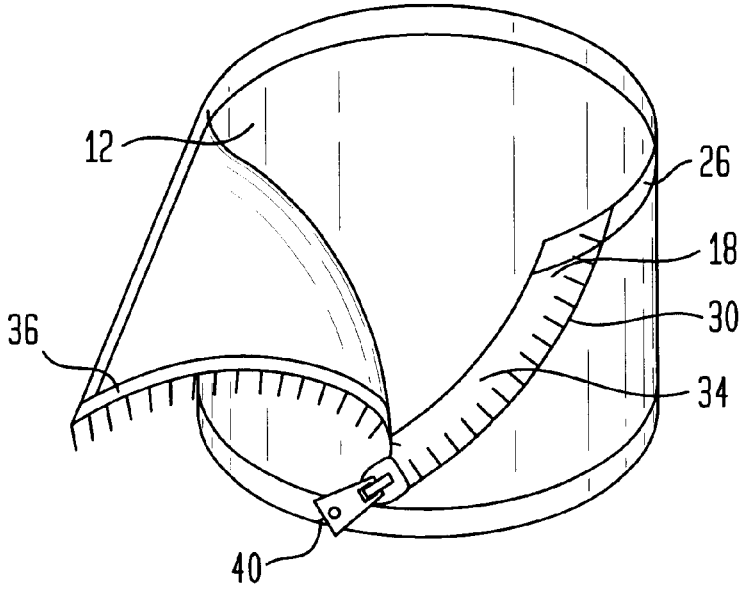
FIG. 2 is a plan view of the present invention in an open position.

Referring to FIGS. 1 and 2, the ends 16 and 18 are joined by a closure 30. In this embodiment, closure 30 is a zipper, and the zipper terminates with a traditional zipper pull-tab 32. Other means for operating the zipper can be substituted for or added to, pull-tab 32, such as rings (metallic, or non-metallic, such as, but not limited to plastics, nylon, and the like), tabs made from materials other than metals, such as plastics, or fabrics ranging from leather, nylon or other durable material.

In the embodiment of the present invention shown in FIG. 1, the zipper 30 is not coextensive with the length of ends 16 and 18. In this manner, the garment 10 of the present invention is intended to be opened and worn by first pulling it over the head and neck of the wearer. Further, because the zipper 30 is not coextensive with the length of the ends, the garment 10 should not come off during use.

Typically, zippers are inserted in garments such that when the garment is worn, the zipper is parallel to the longitudinal axis of the garment (i.e., generally straight up and down, as in a jacket or pair of trousers). In the present invention, the zipper 30 is sewn into the garment at an angle of approximately 45 degrees in relation to the length of the wearer's neck. By insertion of the zipper 30 at the angle shown in FIG. 1, the inventor has found that during an activity such as downhill skiing, the user can readily open the garment 10 by sliding zipper 30 to a desired position, and that the ends 16 and 18 joined by the zipper can be easily separated.

The ends 16 and 18 are joined (FIG. 2) such that there is overlap between the ends and the zipper 30, forming a first flap 34, which flap protects the wearer's neck from contact with the zipper. Second flap 36, attached to end 16, is generally smaller than first flap 34. First flap 34 has a length that is greater than the length of the zipper 30, and first flap 34 may be coextensive with the length of the ends 16 and 18. The garment 10 is closed by taking the remaining portions of each ends 16 and 18 that are not connected by zipper 30 and attaching them to one another by conventional methods of attachment, such as stitching 24, forming seam 40.

The garment 10 is made of a single piece of fabric, essentially a parallelogram (not shown). As shown in FIG. 1, the zipper 30 is sewn into the garment at an approximately 45 degree angle in relation to the length of the wearer's neck. By insertion of the zipper 30 at this particular angle, it has been found that the garment can be opened readily by a user while skiing, and that the garment can be kept open. The combination of easy opening and the ability to remain open is an advantage of the present invention. The present invention offers the wearer the ability to cool off readily, yet not have material covering up the area to be cooled down, or getting in the way, a problem that occurs when a zipper is used in the conventional manner (i.e., straight up and down, along the length of the wearer's neck).

The garment is made such that there is a layer of material beneath the zipper, to protect the wearer's neck from contact with the zipper.

In an embodiment, the present invention is manufactured from a material sold under the trademark POLARFLEECE (Registered trademark of Maldin Mills Industries, Inc., Lawrence Mass.), which is a wool-like, stretch type material now commonly used for the manufacture of outdoor garments, but can be made from any comparable material.

Although not shown in the drawings, a lining can be included in the garment for added warmth, and the lining can be any suitable material. The lining can be sewn into the garment using conventional methods, and depending upon the style selected by a manufacturer, could extend beyond the body of the neck garment 10 of the present invention.

In use, the user opens up the garment 10 of the present invention by unzipping the zipper, and the user pulls the open garment over their head until it rests over their neck, and the zipper is moved to a position that the user finds comfortable. The garment 10 can be worn under the user's outer clothing, such as over a shirt; over outerware such as a jacket, jumpsuit or the like; or in any manner the user finds comfortable. Generally the garment will be worn with its zippered region in the front, but any position that is comfortable to the wearer and which enables the wearer to grasp the zipper can be employed. As the user is participating in a particular activity, as they feel warm, the zipper can be grasped and opened, the ends 16 and 18 are separated, enabling the user to cool themselves down. The open garment remains on the wearer. As the wearer cools off sufficiently, and seeks additional warmth, the garment is then closed by moving the zipper to a comfortable closed position.

Therefore, although this invention has been described with a certain degree of particularity, it is to be understood that the present disclosure has been made only by way of illustration and that numerous changes in the details of construction and arrangement of parts may be resorted to without departing from the spirit and scope of the invention.

I claim:

1. A neck garment comprising:

a body, comprising two ends, the ends being joined by a means for fastening, the means for fastening not being coextensive with the ends;

the means for fastening attached to the body proximate one of the ends, forming a flap, the flap positioned beneath the means for fastening;

the means for fastening being attached at an angle that is not parallel with the length of the neck of a wearer; and a means for connecting, the means for connecting, connecting the ends at a region where the ends are not connected by the means for fastening, such that when the means for fastening is moved to an open position, the neck garment remains open when worn by a wearer.

2. The garment as described in claim 1, wherein the means for fastening is a zipper.

3. The garment as described in claim 2, wherein the zipper is attached to the body at an angle between about 10 degrees and about 170 degrees.

4. The garment as described in claim 3, wherein the zipper is preferably attached to the body at an angle between about 30 degrees and about 150 degrees.

5. The garment as described in claim 4, wherein the zipper is more preferably attached to the body at an angle of about 45 degrees.

6. The garment as described in claim 1, wherein the means for fastening is further attached to the body proximate the second end, forming a second flap, the second flap being beneath the means for fastening.

7. A neck garment comprising:

a body comprising two ends, a zipper attached to the body proximate the ends, thereby forming a first flap and a second flap, both flaps being positioned beneath the zipper, the zipper not being coextensive with the ends, the zipper being attached to the body proximate one of the ends;

a means for connecting, the means for connecting closing the body at a region where the ends are not connected to the zipper; and the zipper being attached at an angle that is about 45 degrees;

such that when the zipper is moved into a closed position, the garment enables the wearer to warm their neck, and when the zipper is moved into an open position, the garment enables the wearer to cool their neck, and the ends are separated and remain open, exposing an area of the wearer and enabling the exposed area to be cooled down without interference from the garment.

* * * * *